US010472740B2

(12) United States Patent
Haska et al.

(10) Patent No.: US 10,472,740 B2
(45) Date of Patent: Nov. 12, 2019

(54) TEXTILE MACHINE AND METHOD FOR OPERATING SAME

(71) Applicant: Maschinenfabrik Rieter AG, Winterthur (CH)

(72) Inventors: Petr Haska, Ceska Trevoba (CZ); Jiri Stech, Usti nad Orlici (CZ); Robert Mikyska, Dolni Dobrouc (CZ)

(73) Assignee: MASCHINENFABRIK RIETER AG, Winterthur (CH)

( * ) Notice: Subject to any disclaimer, the term of this patent is extended or adjusted under 35 U.S.C. 154(b) by 427 days.

(21) Appl. No.: 15/309,459

(22) PCT Filed: Apr. 17, 2015

(86) PCT No.: PCT/IB2015/000507
§ 371 (c)(1),
(2) Date: Nov. 8, 2016

(87) PCT Pub. No.: WO2015/170156
PCT Pub. Date: Nov. 12, 2015

(65) Prior Publication Data

US 2017/0247817 A1 Aug. 31, 2017

(30) Foreign Application Priority Data

May 8, 2014 (CH) ..... 00697/14

(51) Int. Cl.

| | |
|---|---|
| ***D01H 1/40*** | (2006.01) |
| ***B65H 67/048*** | (2006.01) |
| ***D01H 7/92*** | (2006.01) |
| ***B65H 67/04*** | (2006.01) |
| ***D01H 9/02*** | (2006.01) |

(52) U.S. Cl.
CPC ..... *D01H 1/40* (2013.01); *B65H 67/048* (2013.01); *B65H 67/0422* (2013.01);
(Continued)

(58) Field of Classification Search
CPC . D01H 1/40; D01H 7/92; D01H 1/115; D01H 9/18; B65H 67/04; B65H 65/00
See application file for complete search history.

(56) References Cited

U.S. PATENT DOCUMENTS 3,856,222 A * 12/1974 Wust ..... B65H 65/00 242/474.6
4,028,874 A 6/1977 Maag et al.
(Continued)

FOREIGN PATENT DOCUMENTS

CH 656 865 A5 7/1986
CH 705 236 A1 1/2013
(Continued)

OTHER PUBLICATIONS

PCT Search Report, dated Sep. 4, 2015.
Swiss Search Report, dated Oct. 3, 2014.

*Primary Examiner* — Tajash D Patel
(74) *Attorney, Agent, or Firm* — Dority & Manning, P.A.

(57) ABSTRACT

A method and associated textile machine are provided to produce a roving having a protective twist from a fiber bundle fed to a consolidating means. The produced roving is wound with a winding device onto a tube arranged at a winding position. After the wound tube has been fully or partially wound with the roving, a tube change is initiated. During the tube change, the wound tube is removed from the winding position and an empty tube is moved into the winding position. During the tube change, the roving is wound onto the wound tube at least until the roving comes into contact with the empty tube as a result of the tube change such that the production of the roving is not interrupted during the tube change. During the tube change, the roving is wound onto the wound tube in a region that lies outside a region last wound prior to the tube change.

14 Claims, 11 Drawing Sheets

(52) U.S. Cl.
CPC ..... *D01H 7/92* (2013.01); *D01H 9/02* (2013.01); *B65H 2701/311* (2013.01)

(56) References Cited

U.S. PATENT DOCUMENTS

| | | | | |
|---|---|---|---|---|
| 4,216,920 | A * | 8/1980 | Tambara | B65H 67/048 242/474.6 |
| 4,431,138 | A | 2/1984 | Schiminski et al. | |
| 5,228,630 | A * | 7/1993 | Nakai | B65H 54/2893 242/474.5 |
| 6,073,435 | A * | 6/2000 | Koltze | D01H 1/08 57/264 |
| 7,661,259 | B2 | 2/2010 | Griesshammer et al. | |
| 8,042,324 | B2 | 10/2011 | Griesshammer et al. | |
| 9,677,197 | B2 * | 6/2017 | Blankenhorn | D01H 1/115 |
| 2012/0110973 | A1 * | 5/2012 | Haska | D01H 1/115 57/403 |
| 2014/0239114 | A1 | 8/2014 | Haska et al. | |
| 2014/0284415 | A1 | 9/2014 | Griesshammer | |

FOREIGN PATENT DOCUMENTS

| | | | |
|---|---|---|---|
| CH | 705 237 | A1 | 1/2013 |
| DE | 24 47 715 | | 4/1976 |
| EP | 2 112 258 | A2 | 10/2009 |
| WO | WO 2005/026421 | A1 | 3/2005 |
| WO | WO 2009/086646 | A1 | 7/2009 |
| WO | WO 2013/010279 | A1 | 1/2013 |
| WO | WO 2013/053634 | A1 | 4/2013 |

* cited by examiner

TEXTILE MACHINE AND METHOD FOR OPERATING SAME

FIELD OF THE INVENTION

The present invention relates to a method for operating a textile machine which serves to produce roving, wherein during roving production a roving having a protective twist is produced by means of at least one consolidating means from a fiber bundle that is fed to the consolidating means. The roving produced by the consolidating means is wound by a winding device onto a tube arranged in the region of a winding position. A tube change takes place after the tube has been fully or partially wound with roving, and wherein during the tube change the wound tube is removed from the winding position and an empty tube is moved into the region of the winding position. A textile machine for producing a roving is also proposed, wherein the textile machine has at least one consolidating means by which a protective twist can be given to a fiber bundle that is fed to the consolidating means. The textile machine has at least one winding device, by means of which the roving can be wound onto a tube.

BACKGROUND

Roving is produced from slivers which are usually pretreated (for example doubled) by drafting and serves as a precursor for the subsequent spinning process, in which the individual fibers of the roving are spun, for example by means of a ring spinning machine, to form a yarn. In order to give the roving the strength necessary for the further processing, it has proven to be advantageous, during production of the roving, to draft the supplied fiber bundle by means of a drafting system, which is usually part of the textile machine in question, and then to provide it with a protective twist. The strength is important in order to prevent tearing of the roving during the winding onto a tube and/or during the feeding thereof to the downstream spinning machine. The protective twist that is given must on the one hand be sufficient to ensure that the individual fibers hold together during the individual winding and unwinding processes and corresponding transport processes between the respective types of machine. On the other hand, it must also be ensured that, despite the protective twist, the roving can be further processed in a spinning machine—the roving must therefore still be able to be drafted.

For producing such a roving, use is primarily made of so-called flyers, the delivery speed of which is nevertheless limited due to centrifugal forces that occur. There have therefore already been many proposals for circumventing the flyers or replacing them with an alternative type of machine.

In this connection, it has also already been proposed, inter alia, to produce roving by means of air-jet spinning machines, in which the protective twist is created by means of swirled air flows. The basic principle here consists in guiding a fiber bundle through a consolidating means designed as an air spinning nozzle, in which an air vortex is generated. This ultimately brings about the situation whereby some of the outer fibers of the supplied fiber bundle are wrapped as so-called wrapping fibers around the centrally running fiber strand, which in turn consists of core fibers running substantially parallel to one another.

Another method for roving production is disclosed in DE 24 47 715 A1. The consolidation of the unconsolidated fiber bundle described therein takes place by a consolidating means which brings about not a twisting, but rather a helical wrapping of a sliver with one or more filament yarns, preferably monofilament yarns, which hold the fiber bundle together and give it its strength. The spirals of the individual filament yarns may in this case be arranged in the same direction or in opposite directions. Preference is given to two filament yarns which are arranged in opposite directions of rotation and in a manner crossing over one another. The roving produced in this way is thus composed essentially of a sliver of parallel staple fibers and one or more fine-titer filament yarns wrapping helically around the sliver.

There are various possibilities for wrapping the filament yarn or filament yarns around the unconsolidated fiber bundle. For example, the filament yarn can be applied onto small bobbins of small diameter. The filament yarn is then drawn off from the stationary bobbin and drawn through the bobbin axis together with the fiber bundle, whereby the filament yarn is wrapped around the fiber bundle and the number of windings drawn off from the bobbin corresponds to the number of wraparounds applied to the fiber bundle. In principle, it is also possible to design the consolidating means in such a way that only the unconsolidated fiber bundle is guided through the bobbin axis, so as consequently to relocate the winding process to behind the filament yarn bobbin. The wrapping point should in this case be defined by a suitable thread guide.

Another method for producing roving is described in WO 2009/086646 A1, wherein the method comprises the following steps: 1) providing a fiber bundle in the form of two, preferably untwisted, slivers, 2) applying S and Z twists over alternating regions of the two slivers, wherein regions of S and Z twists on the respective sliver are separated by regions without any twist, and 3) bringing together the two slivers provided with S and Z twists to form a roving, wherein the two slivers automatically twist together on account of their tendency to twist back.

The S and Z twists may be created for example by means of two elements of the consolidating means used, which hold the respective sliver in a clamped manner, wherein at least one element, preferably both elements, apply opposite twists on the sliver in an alternating manner on both sides by a relative movement on the surface thereof transversely to the longitudinal direction of the sliver. At the same time, the respective sliver is moved in the sliver direction. However, the S and Z twists can also be created by means of an aerodynamic, in particular pneumatic, method.

The alternating S and Z twists are moreover interrupted by intermediate regions without any twist. The two slivers provided with S and Z twists in the same way are finally brought together at the so-called joining point. Here, the slivers start to twist together automatically, that is to say they wind around each other. This so-called double-folding maintains the S and Z twists in the individual slivers, so that a self-stabilizing two-component roving is obtained. In principle, however, care should be taken here to ensure that the regions without any twist in the first sliver should be arranged offset in the longitudinal direction relative to the regions without any twist in the second sliver, so that two regions without any twist in the first and second sliver never lie next to one another in the resulting roving, since the strength of the roving depends substantially on the phase position of the regions without any twist in the two slivers. As described above, the rovings are therefore always brought together by the consolidating means in such a way that their regions without any twist lie out of phase. The roving produced in this way ultimately has a greater strength than an untwisted fiber bundle, the strength ultimately being sufficient to wind the roving onto a bobbin and unwind it again from the latter without false drafts.

One problem with these textile machines and methods, however, is the tube change, that is to say the replacing of a tube wound with roving by an empty tube. In particular, the previously required break in roving production by the consolidating means prior to the tube change and the subsequent roving production start procedure after the tube change result in an undesired reduction in productivity of the textile machine.

SUMMARY OF THE INVENTION

It is therefore an object of the invention to propose a method for operating a textile machine which serves to produce roving, as well as a corresponding textile machine, which are characterized by a tube change that is as efficient as possible. Additional objects and advantages of the invention will be set forth in part in the following description, or may be obvious from the description, or may be learned through practice of the invention.

The objects are achieved by a method and a textile machine having the features described herein.

According to the invention, the method is characterized in that the production of the roving is not interrupted during the tube change, wherein the roving produced or delivered by the consolidating means is wound onto the wound tube during the tube change at least until it comes into contact with the empty tube as a result of the tube change. The method according to the invention thus proposes that the production of the roving is continued even during the tube change. Therefore, even during the tube change, the consolidating means is fed a fiber bundle (which is preferably drafted by a drafting system of the textile machine before entering the consolidating means), which is preferably provided with a protective twist in the consolidating means. The roving is in this case wound onto the tube located in the region of the winding position until the time of tube change, and during the tube change is brought into contact with a new, empty tube, which at this point in time is preferably still located in a region of the winding device spaced apart from the winding position. At the moment at which the roving comes into contact with the empty tube (or shortly thereafter), a cutting of the roving finally takes place between the wound tube and the tube that is initially empty, wherein the latter tube is brought into the region of the winding position at the same time or with a time offset. The roving delivered thereafter by the consolidating means is ultimately wound onto the new tube, so that the tube change can take place without any break in production of the roving. The wound tube, which after the tube change is located in the region of a tube removal position (in which the empty tube was located prior to the tube change), can finally be removed from the winding device and replaced by another empty tube so that the winding device is ready for the next tube change. The production of the roving can thus be maintained without any interruption and with suitably interposed tube changes until no fiber bundle is left or the textile machine must be stopped for some other reason.

At this point, it should be pointed out in general (and thus also in connection with the method according to the invention, which will be described in more detail below) that the consolidating means may be designed in various ways. For example, it would be conceivable that the consolidating means is suitable for producing the roving in the manner described in the abovementioned documents WO 2009/086646 A1 and DE 24 47 715 A1.

Preferably, however, the textile machine is designed as an air-jet spinning machine and the consolidating means is designed as an air spinning nozzle, by means of which the protective twist in the roving is created, as described above, by means of swirled air flows (part of such a textile machine designed as an air-jet spinning machine is described by way of example in the description of the figures).

It is advantageous if the roving delivery speed of the consolidating means during the tube change remains constant and/or differs by at most 30%, preferably at most 25%, from the roving delivery speed that the consolidating means has before and/or after the tube change. In particular, it is advantageous, at least temporarily, to reduce or to increase the roving delivery speed by reducing the delivery speed of the drafting system preferably arranged upstream of the consolidating means and, if an air spinning nozzle is used as the consolidating means, by reducing the pressure and/or volume flow of the spinning air necessary for the swirled air flow inside the spinning nozzle. It may also be advantageous if the rotational speed of the tube being wound prior to the change process and/or the rotational speed of the tube that is empty prior to the change process is increased or reduced, at least temporarily, during the change process, wherein, here too, deviations of up to 25% in comparison to the rotational speed of the tube being wound prior to the change process are conceivable. In any case, the rotational speeds must be adapted to one another and to the roving delivery speed in such a way that no tearing of the roving between the consolidating means and the wound tube, or between the wound tube and the empty tube, occurs during the tube change. In this connection, it would finally also be possible to adapt the rotational speeds of the respective tubes as a function of the sag of the roving between the consolidating means (or a draw-off unit arranged downstream of the consolidating means) and the tube being wound at the point in time in question, wherein the sag can be monitored by means of one or more sensors.

It is also advantageous if both the wound tube and the tube that is empty at the start of the tube change rotate about a rotation axis during the tube change, wherein the rotation of the empty tube can be brought about just shortly before the tube change or just at the start thereof. To this end, the winding device preferably has at least two tube holders, by means of which in each case one tube can be fixed, wherein the tube holders should in turn be connected to separate drives in order to be able to adjust individually the rotational speeds of the respective tube holders and thus of the tubes held by the latter.

It is also extremely advantageous if the roving during the tube change is guided by means of a traversing element, wherein the traversing element is preferably moved back and forth parallel to the rotation axis of the tubes. The position of the turning points of the traversing movement may change during the winding process in order to provide the bobbin (=the tube wound with roving) with a cone for example in the region of its ends. The rotation axis are preferably oriented vertically, wherein the tube holders are preferably part of a tube change device of the winding device, which can likewise be rotated by a drive about a vertical rotation axis in order to move the tube being wound prior to the tube change from the winding position into the region of a tube change position during the tube change and at the same time to move the empty tube provided in the region of the tube removal position prior to the tube change into the region of the winding position.

The traversing element may be formed for example by a cam drum that guides the roving or by a traversing finger which moves back and forth in a traversing manner and comprises a guide for the roving. Preferably, however, the traversing element is designed as a so-called pressing finger. The pressing finger has for example an elongate, for example rod-shaped, section which is wrapped around one or more times by the roving during the winding process so that an increasing friction force acts on the roving in its movement direction. As a result, the roving is under a tension during the winding process, which makes it possible to wind the roving onto the tube in a suitably tight manner, wherein the tension generated by the friction is greatest in the region at which the roving leaves the pressing finger on its way to the tube. In order to prevent any tearing of the roving in this region, the pressing finger has a guide surface for the roving, which guide surface during the winding process is pressed by means of a drive against the uppermost position of the roving already wound onto the tube. Since the distance between the guide surface and the section of the previously wound roving adjacent to the guide surface is thereby much smaller than the average fiber length of the roving, a tearing of the roving in this region is ruled out. Advantages are also obtained if the traversing rate of the traversing element is increased at least temporarily during the tube change. For example, it would be conceivable to increase the traversing rate as soon as the roving during the tube change comes into contact with the empty tube or with an adhesive strip thereof (the adhesive strip may have a rough surface and causes the roving to adhere better to the surface of the empty tube as soon as it comes into contact with the adhesive strip). As an alternative, it is also conceivable to increase the traversing rate when the roving comes into contact with the empty tube or with the adhesive strip thereof. The increase ensures that the roving is securely grasped by the empty tube in order to be able reliably to wind it onto the latter. Besides varying the traversing rate, it may also be advantageous in addition or as an alternative to vary, preferably to reduce, the traversing width (that is to say the spacing of the turning points of the traversing movement) at least temporarily during the tube change. For example, the traversing width could be reduced during the contacting of the roving (or shortly before and/or after this) in such a way that the roving is wound onto the empty tube at least temporarily only in the region in which the adhesive strip is located.

It is also advantageous if the roving, during the tube change and preferably by means of the traversing element, is wound onto the wound tube in a region that lies outside the region last wound prior to the tube change. The roving may be wound for example in the region of a top cone of the bobbin body (that is to say, of the roving located on the tube), wherein the roving in this region is preferably wound upward in a helical manner. This so-called tie formation prevents the roving from coming loose during subsequent transport, during which said cone is usually located in the upper region of the vertically oriented tube, and thereby causing an undesired unwinding of the roving from the tube under the effect of gravity.

It is also extremely advantageous if the traversing element, immediately before the tube change, is moved back and forth between two turning points, wherein the traversing element during the tube change is moved into a region that lies outside the region located between the turning points. Prior to the tube change, the turning points delimit the cylindrical section of the bobbin body which preferably lies between two conically running edge regions. During the tube change, the traversing element is preferably guided upward such that the roving is wound, in particular in a helical manner, onto the upper conically running edge region of the bobbin body. As a result, the above-described tie formation finally takes place, so that the roving no longer automatically comes loose from the bobbin body during subsequent transport of the wound tube.

It is advantageous if the roving, after it has come into contact with the empty tube, is cut between the wound tube and the tube that is empty at the start of the tube change. The cutting may take place for example by means of a cutting element which, between the wound tube and the tube that is empty at the start of the tube change, is pivoted or moved in some other way into the course of the roving and thereby cuts the roving. It is also conceivable to adjust the rotational speeds of the wound tube and of the tube that is empty prior to the tube change so that the roving tears between the two tubes as a result of an increased tension. In any case, the cutting of the roving means that the wound tube can be removed from the winding device after the tube change and the roving being delivered by the consolidating means can be wound onto the tube that is empty prior to the tube change.

Advantages are also obtained if the roving during the tube change is in contact, at least temporarily and preferably until the point in time at which the roving is cut according to the preceding paragraph, both with the wound tube or the roving wound onto the wound tube and with the tube that is empty at the start of the tube change. If the empty tube has an aforementioned adhesive strip, the contacting of the roving in the time period should take place outside the adhesive strip in order to prevent premature tearing of the roving. If the roving ultimately traverses into the region of the adhesive strip while it is in contact with both tubes, then the cutting can take place since the roving being delivered by the consolidating means at this point in time is grasped by the adhesive strip and is wound onto the empty tube having the adhesive strip by virtue of the rotation of the latter.

It is particularly advantageous if the roving during the tube change is cut at a point in time at which the traversing element is located outside the region of the wound tube that was last wound prior to the tube change. The end of the roving located on the wound tube that is created as a result of the cutting process is in this case wound on in a region which is located below or preferably above the two turning points, resulting in the tie formation.

Advantages are also obtained if the traversing element, immediately after the tube change, is moved back and forth between two turning points, the mutual spacing of which is greater than the mutual spacing of the turning points between which the traversing element was moved back and forth immediately prior to the tube change. As a result, it is possible to produce a bobbin which has a cylindrical middle region and two conical edge regions adjoining the middle region on both sides thereof, wherein the cones taper outward from the cylindrical middle region in the direction of the rotation axis of the tube.

It is also advantageous if the wound tube and the tube that is empty at the start of the tube change are held stationary by a tube change device prior to the tube change, and during the tube change are moved by a movement, preferably by a rotation, of the tube change device. The tube change device, which should be part of the winding device, may comprise for example a platform which can be rotated by means of a drive about a rotation axis which runs in particular vertically.

It is particularly advantageous if during the tube change the wound tube is moved from the winding position into the region of a tube removal position and the tube that is empty at the start of the tube change is moved from the tube removal position into the region of the winding position. The winding position is preferably located closer to the traversing element than the tube removal position, wherein the bobbin formation, that is to say the winding of an empty tube with roving, takes place in the region of the winding position. In the region of the tube removal position, a wound tube can finally be replaced by an empty tube, so that during roving production an empty tube is always available for a tube change process.

The movement of the wound tube and empty tube takes place for example by rotating the above-described tube change device.

The textile machine according to the invention is finally characterized in that it has at least one controller which is designed to operate the textile machine according to what has been described above or will be described below. In particular, the textile machine may additionally have any of the physical features that are described in the description or the claims and/or are shown in the figures.

In this connection, it is particularly advantageous if the winding device comprises at least two tube holders which can each be set in a rotational movement, preferably independently of one another, by means of a drive, wherein the tube holders are part of a tube change device, by means of which the tubes held by the tube holders can be moved from a winding position to a tube removal position and/or vice versa. With regard to the advantages of this embodiment, reference is made in particular to what has been stated above in relation to the tube change device.

BRIEF DESCRIPTION OF THE DRAWINGS

Further advantages of the invention are described in the following exemplary embodiments, in which.

DETAILED DESCRIPTION

Figure 1:
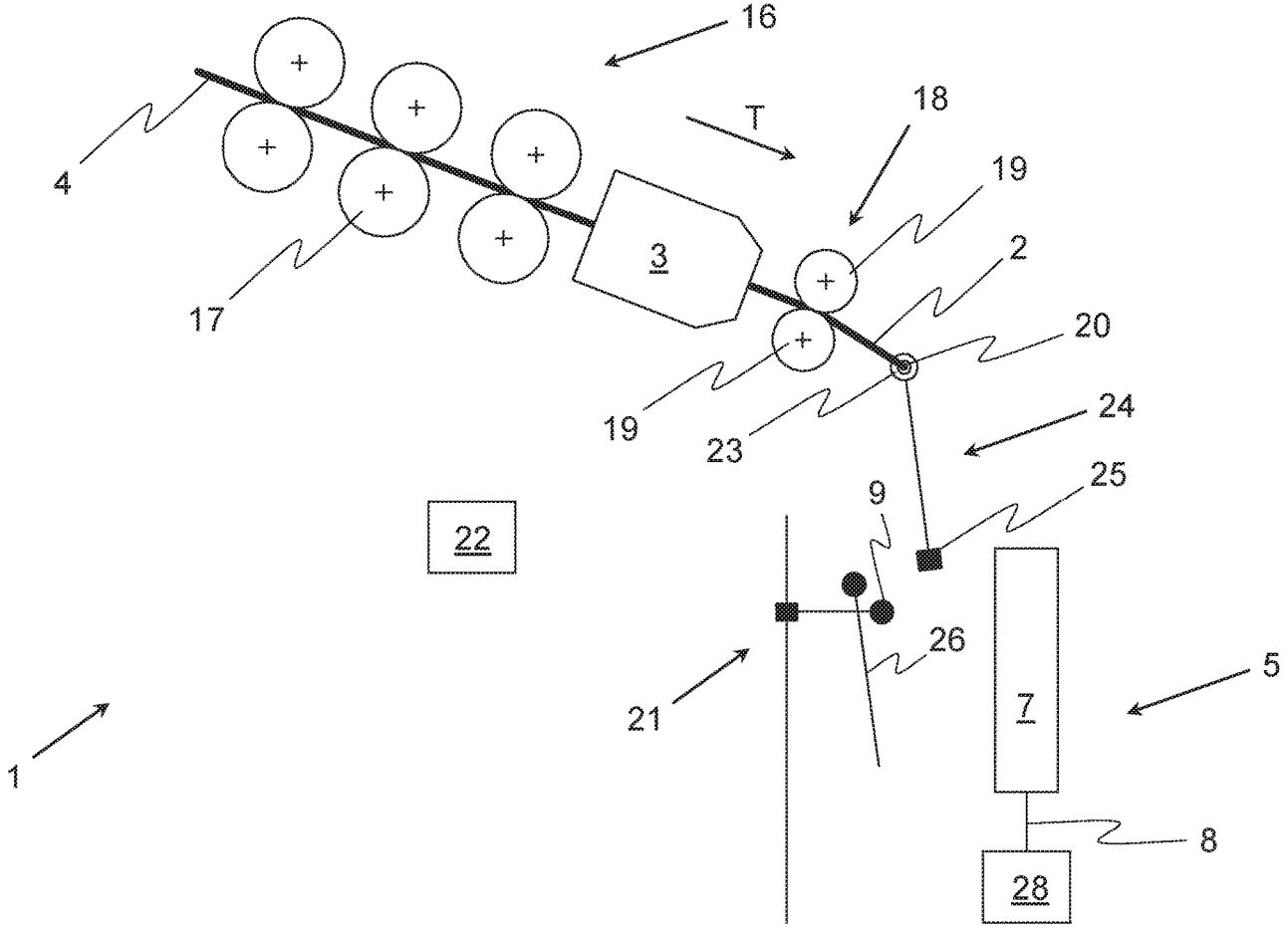
FIGS. 1 to 3 show part of a roving production start procedure on a textile machine in the form of an air-jet spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
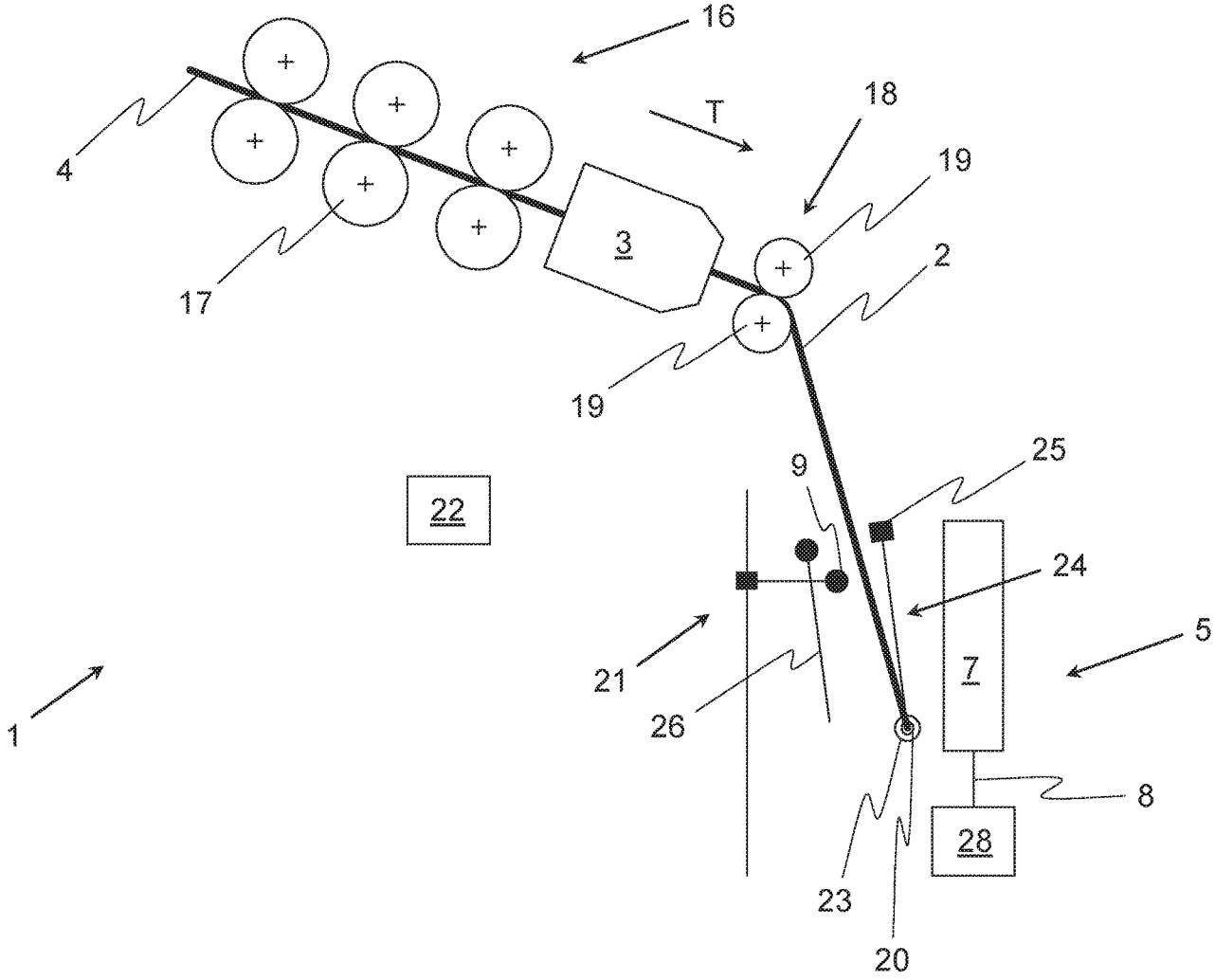
Figure 3:
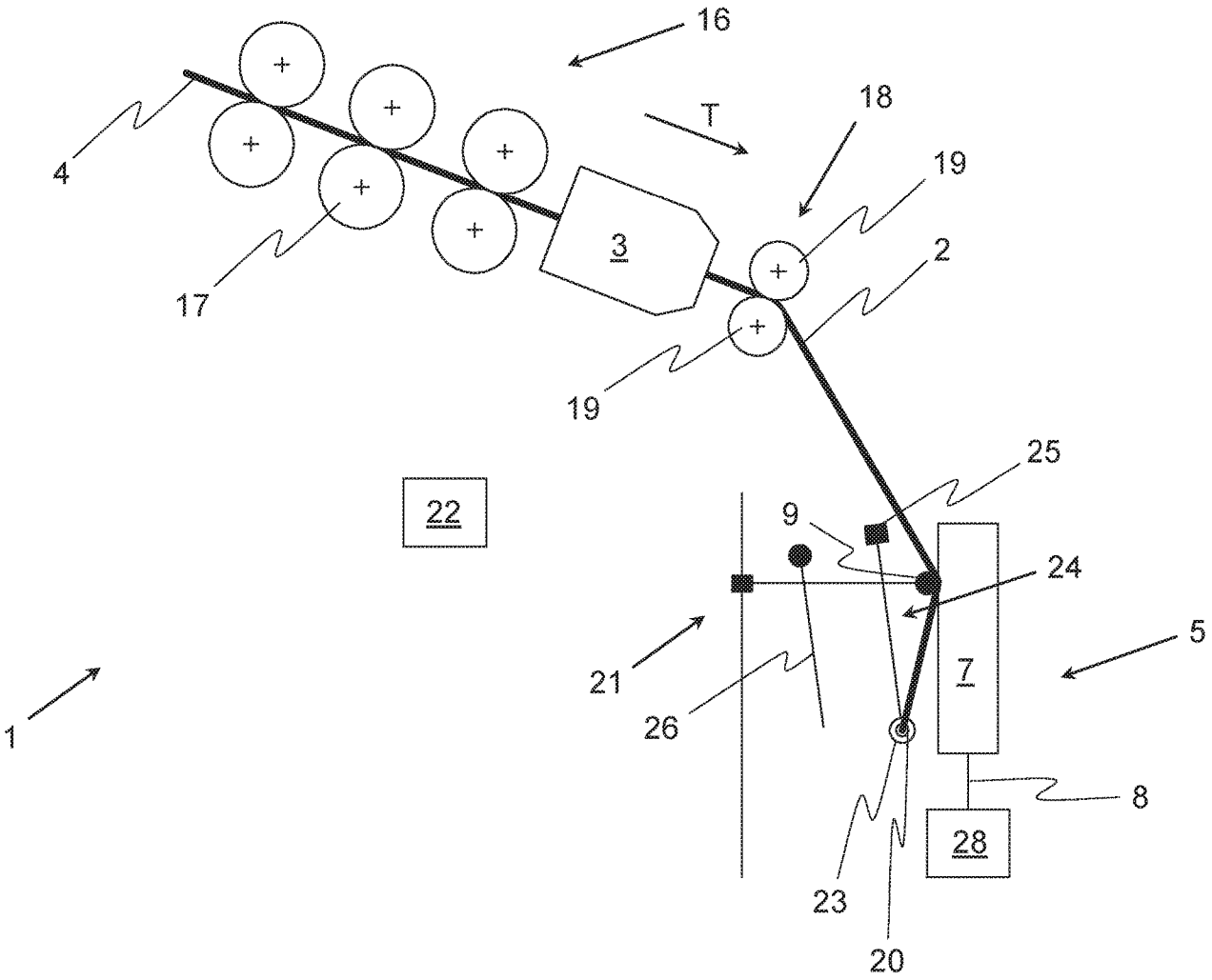

FIGS. 1 to 3 show a schematic view of part of a textile machine according to the invention in the form of an air-jet spinning machine 1 serving as an example of such a textile machine, which serves to produce a roving 2, at different points in time during a roving production start procedure. The air-jet spinning machine 1 may, if necessary, comprise a drafting system 16 comprising a plurality of corresponding drafting system rollers 17 (only one of the drafting system rollers 17 has been provided with a reference sign for clarity reasons), to which there is fed a fiber bundle 4, for example in the form of a doubled-over draw frame sliver. The illustrated air-jet spinning machine 1 also comprises in principle a consolidating means, spaced apart from the drafting system 16, in the form of an air spinning nozzle 3 having an internal vortex chamber (known from the prior art and therefore not shown) and a yarn forming element (likewise known from the prior art and therefore not shown). In the air spinning nozzle 3, the fiber bundle 4 or at least a portion of the fibers of the fiber bundle 4 is provided with a protective twist.

The air-jet spinning machine 1 may also comprise a draw-off unit 18 comprising preferably two draw-off rollers 19 for the roving 2 (the draw-off unit 18 is not absolutely necessary). A winding device 5 arranged downstream of the draw-off unit 18 is also usually present, which winding device in turn should comprise at least one tube drive 28 (only shown in FIGS. 1 to 4) and in each case a tube holder 14 which is connected to the tube drive 28 and is known in principle, by means of which a tube 7 can be fixed and can be set in a rotational movement by means of the tube drive 28.

In the embodiment according to the invention, the winding device 5 has at least two tube holders 14, as can be seen below in connection with FIGS. 4 to 10, so that, besides a tube holder 14 for a tube 7 that is currently being wound during operation of the air-jet spinning machine 1, one or more further tube holders 14 for empty tubes 7 may be present.

The air-jet spinning machine 1 shown as an example of a textile machine according to the invention operates according to a special air-jet spinning process. In order to form the roving 2, the fiber bundle 4 is guided in a transport direction T via an inlet opening (not shown) into the vortex chamber of the air spinning nozzle 3. There, it is given a protective twist, that is to say at least a portion of the fibers of the fiber bundle 4 is grasped by a swirled air flow which is created by suitably placed air nozzles. A portion of the fibers is thereby pulled at least a little way out of the fiber bundle 4 and is wound around the tip of a yarn forming element which protrudes into the vortex chamber.

Finally, the fibers of the fiber bundle 4 are drawn out of the vortex chamber via an inlet mouth of the yarn forming element and a draw-off channel which is arranged inside the yarn forming element and adjoins the inlet mouth. In doing so, the free fiber ends are finally also drawn on a helical trajectory in the direction of the inlet mouth and wrap as wrapping fibers around the centrally running core fibers, resulting in a roving 2 which has the desired protective twist.

Due to the only partial twisting of the fibers, the roving 2 has a draftability which is essential for the further processing of the roving 2 in a downstream spinning machine, for example a ring spinning machine. Conventional air-jet spinning devices, on the other hand, give the fiber bundle 4 such a pronounced twist that the requisite drafting following yarn production is no longer possible. This is also desired in this case since conventional air-jet spinning machines 1 are designed to produce a finished yarn, which is generally intended to be characterized by a high strength.

Before a tube 7 can be wound with roving 2, a start procedure must take place, during which the roving 2 leaving the air spinning nozzle 3 is brought into contact with the tube 7. Part of a possible start procedure is shown in FIGS. 1 to 3.

Firstly, a fiber bundle 4 is fed into the air spinning nozzle 3 by starting the drafting system 16. The above-described roving production, during which the fiber bundle 4 is given a protective twist, takes place in the air spinning nozzle 3. Finally, the roving 2 leaves the air spinning nozzle 3 via an exit opening (not shown in said figures) and is grasped by the air flow of a suction unit 24. The suction unit 24 preferably has a suction nozzle 23 with a suction opening 20, via which air and thus also the roving 2 leaving the air spinning nozzle 3 can be sucked up or sucked in. In this stage shown in FIG. 1, therefore, the roving 2 produced by the air spinning nozzle 3 leaves the air spinning nozzle 3 and is sucked into the suction unit 24 via the suction opening 20, wherein the delivery speed of the air spinning nozzle 3 preferably corresponds to the delivery speed prevailing after the start procedure or is only slightly lower than said speed.

In general, it should be noted at this point that the entire start procedure preferably takes place without any break in roving production or roving delivery, that is to say while the drafting system 16 is active, the air spinning nozzle 3 is active and, if present, the draw-off unit 18 is active (that is to say is drawing a roving 2 out of the air spinning nozzle 3), so that a particularly high efficiency of the illustrated air-jet spinning machine 1 can be ensured.

An illustrated controller 22 is also provided, which is operatively connected to the described elements of the air-jet spinning machine 1 in order to carry out inter alia the described start procedure and the tube change that will be described below. The controller 22 may be present for each spinning position of the air-jet spinning machine 1. It is also conceivable that one controller 22 is responsible for a plurality of spinning positions.

In the next step (see FIG. 2), the suction unit 24 is moved (preferably the suction nozzle 23 is pivoted about a pivot axis 25) into a transfer position in which the suction opening 20 and thus also a section of the roving 2 (which is moreover still being delivered by the air spinning nozzle 3) are located in the region of the tube surface. Contact between the tube 7 and the roving 2 preferably does not yet exist at this stage.

While the suction unit 24 is assuming its position shown in FIG. 2 (or shortly thereafter), the traversing element 9 of a traversing unit 21 is moved into the position shown schematically in FIG. 3, in which the roving 2 is grasped and guided by the traversing element 9. The traversing unit 21 thereby moves the roving 2 into the vicinity of the tube 7 or brings about direct contact between the tube 7 and the roving 2, so that the roving 2 (preferably under the effect of suitable rough surface sections of the tube 7) is grasped by the tube 7.

At the same time or shortly thereafter, a cutting unit is finally activated, which comprises for example a movable (preferably pivotable) cutting element 26. The cutting element 26 is thereby brought into contact with the roving 2, preferably with the section thereof that is located between the traversing unit 21 and the suction opening 20. At this moment, a local decelerating of the roving 2 occurs in the region which comes into contact with the cutting unit, so that the roving 2 finally tears between the tube 7 and the cutting unit since it continues to be wound up by the rotating tube 7, that is to say has a tensile force applied to it. Due to the tearing of the roving 2, a section of the roving 2 on the suction unit side is obtained, which can be conveyed away via the suction unit 24. A roving section on the air spinning nozzle side is also obtained, which is already grasped by the tube 7 and extends between the air spinning nozzle 3 and the tube 7.

By virtue of the further rotation of the tube 7, the roving 2 still being delivered by the air spinning nozzle 3 is continuously wound onto the tube 7, wherein the traversing element 9, by virtue of a movement in the direction of the rotation axis 8 of the tube 7, ensures that the roving 2 is uniformly wound onto the tube 7. At this stage in which the cutting element 26 and also the suction unit 24 have assumed their original positions, the air-jet spinning machine 1 is finally in its normal mode following the roving production start procedure, in which normal mode the tube 7 is wound with roving 2 until the desired bobbin size is achieved.

The necessary tube change according to the invention will now be described below.

Figure 4:
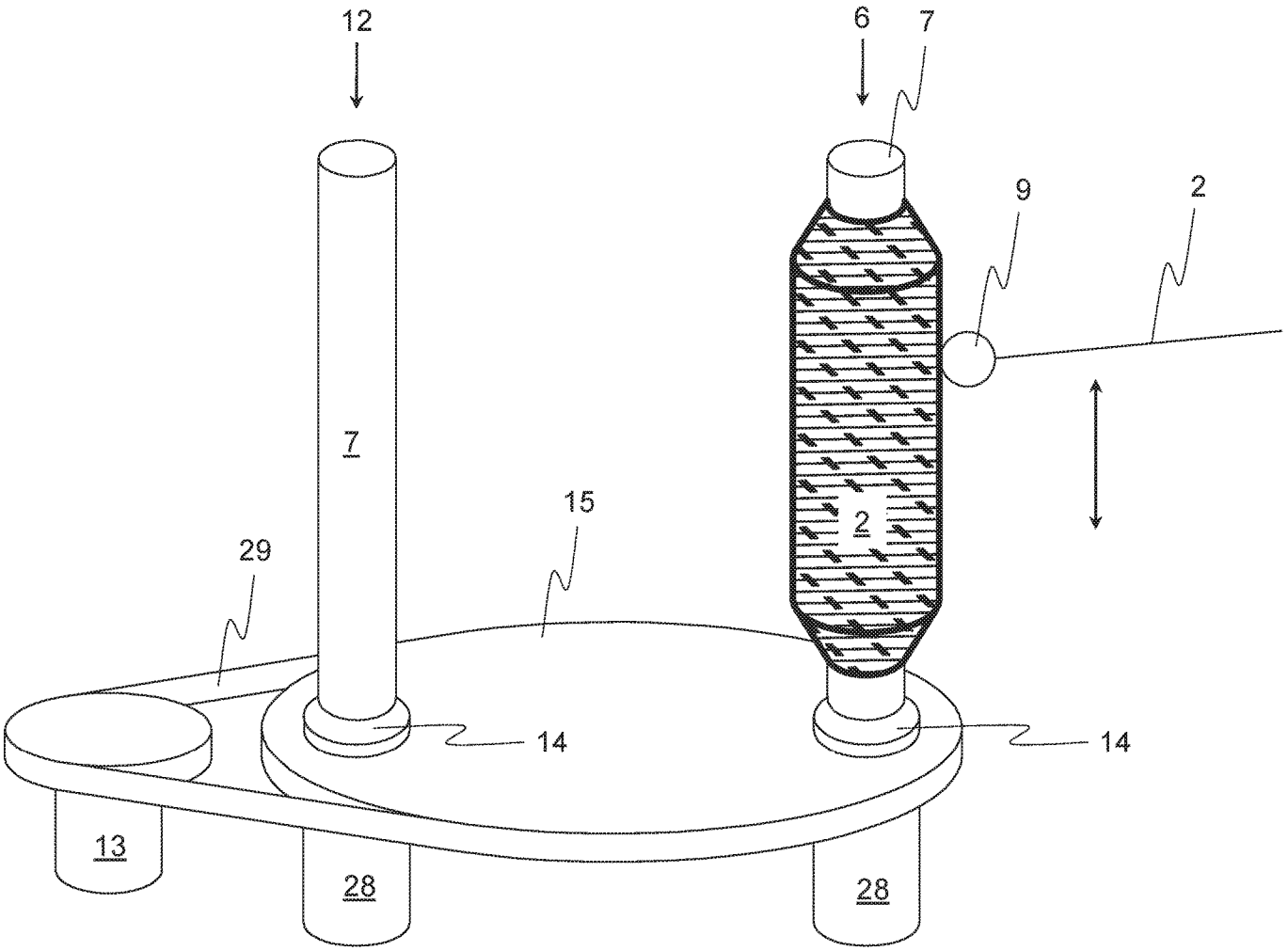
FIGS. 4 to 6 show a perspective part of a winding device of a textile machine according to the invention, in the form of an air-jet spinning machine, during the start of a tube change.
Figure 5:
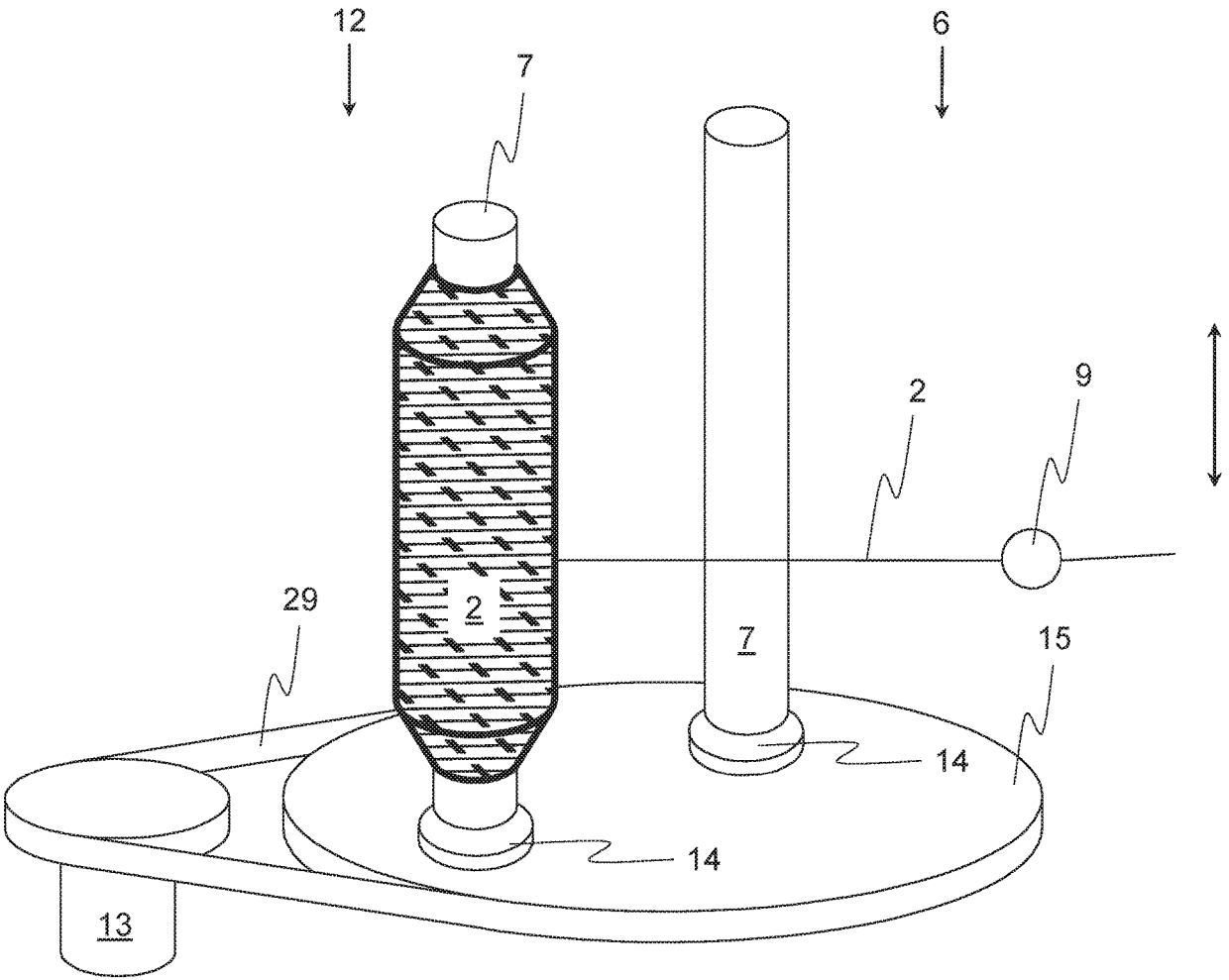
Figure 6:
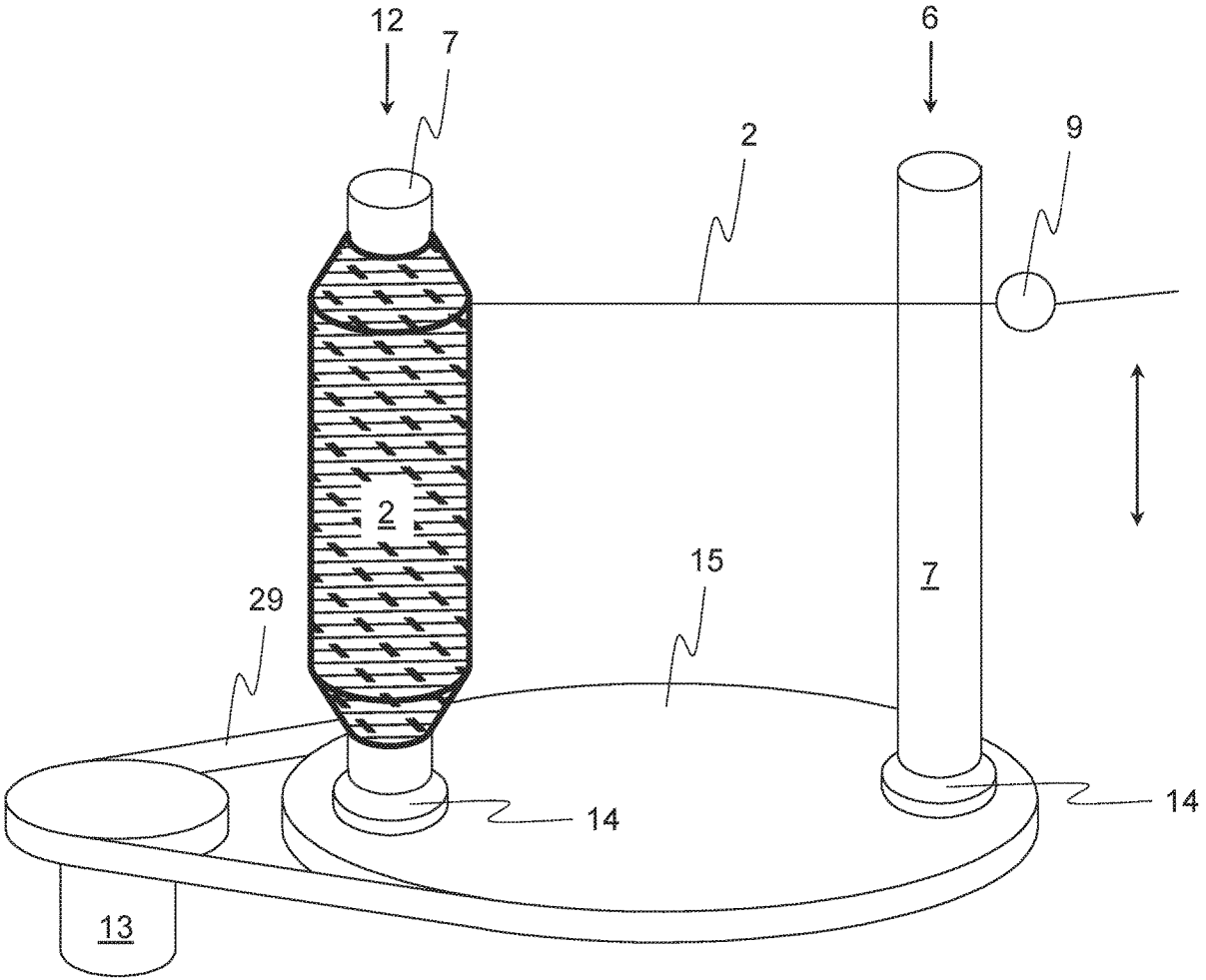

In this connection, FIGS. 4 to 6 show part of the winding device 5 of the air-jet spinning machine 1, which in principle comprises two (or if necessary even more) tube holders 14, by means of which in each case one bobbin can be fixed. Each of the tube holders 14 can be set in a rotational movement via a tube drive 28 in order to be able to set the individual tubes 7 in a rotational movement, preferably independently of one another. Furthermore, the tube holders 14 are part of a tube change device 15 which can likewise be set in a rotational movement via a drive 13 (for example with the interposition of a belt 29 or other transmission means), wherein the rotation axis of the tube change device 15 preferably runs parallel to the rotation axis 8 of the tubes 7.

FIG. 4 shows the stage after the described start procedure, in which the tube 7 is sufficiently wound with roving 2 and a tube change is pending, wherein at this point in time roving 2 that is still being delivered by the air spinning nozzle 3 is being wound onto the tube in a manner traversed by the traversing element 9 (the traversing movement here takes place in principle in the direction of the double-headed arrow).

Once the tube change has been initiated by the controller 22, the tube change device 15 begins to rotate during ongoing roving production, so that the wound tube 7, onto which roving 2 is still being wound, is moved from the winding position 6 into the region of a tube removal position 12 (cf. FIGS. 4 to 6, wherein the tube change device 15 rotates continuously in the clockwise direction). At the same time, an empty tube 7 is moved from the tube removal position 12 into the region of the winding position 6.

The moment of the tube change shown in FIG. 4 is shown in side view in FIG. 7, wherein only the sections relevant to what is stated below are shown. In addition, the empty tube 7 arriving in the region of the winding position 6 in FIG. 7 is provided with an adhesive strip 27, which in principle should be present on all the tubes 7 shown in the individual figures (even though this is not shown in all the figures).

Figure 7:
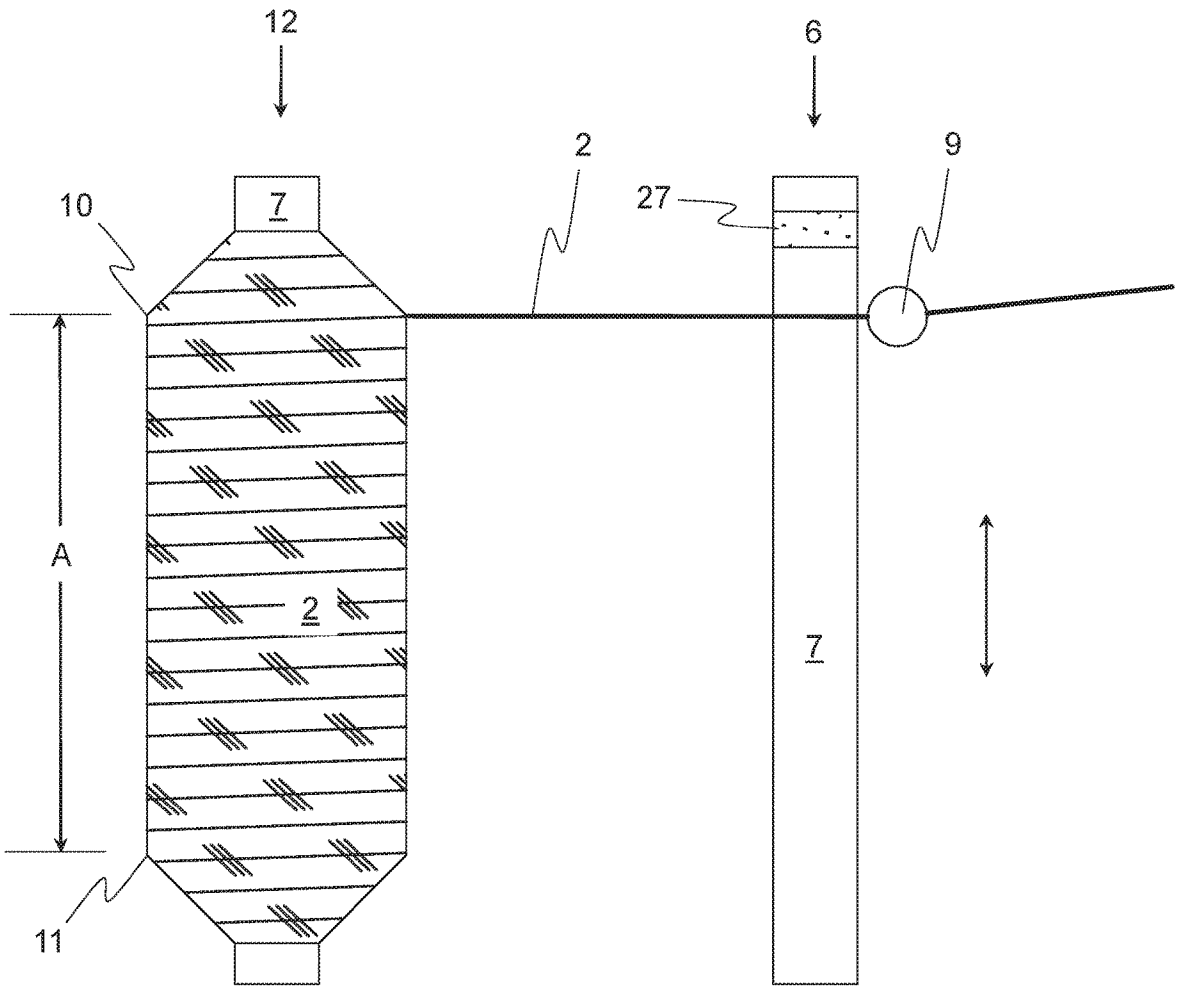
FIGS. 7 to 10 show a side view of part of a winding device of a textile machine according to the invention, in the form of an air-jet spinning machine, toward the end of a tube change.
Figure 8:
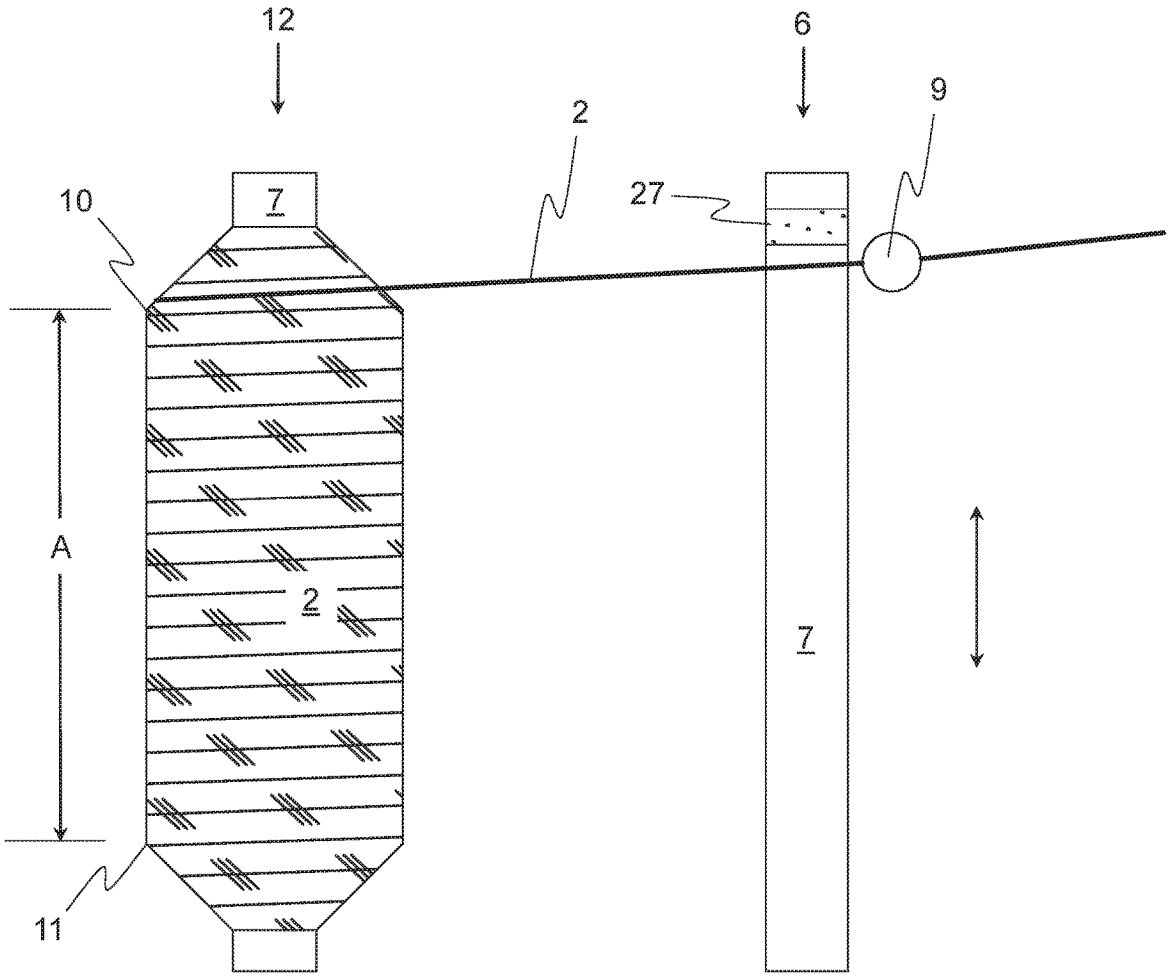

In any case, it is advantageous if the traversing element 9 is moved back and forth between two turning points 10, 11 until the start of the tube change or until the moment shown in FIG. 7, wherein the position of the turning points 10, 11 can be moved in relation to one another during the winding process 5 so that ultimately the outer contour of the wound tube 7 shown in FIGS. 4 to 10 is obtained.

During the tube change, the traversing element 9 is moved upward such that it is located outside the two turning points 10, 11 at which the traversing element 9 has performed a change of direction prior to the tube change. The movement in question can be seen from a comparison of FIGS. 7 and 8. This has the advantage that the roving 2 enters into the region of the adhesive strip 27 of the empty tube 7 and can be grasped thereby. At the same time, the movement of the traversing element 9 means that the roving 2 is no longer wound onto the cylindrical region of the wound tube 7 lying inside the turning points 10, 11. Instead, the roving 2 is wound around the conical region located above the first turning point 10, wherein this winding takes place in a helical manner.

Figure 9:
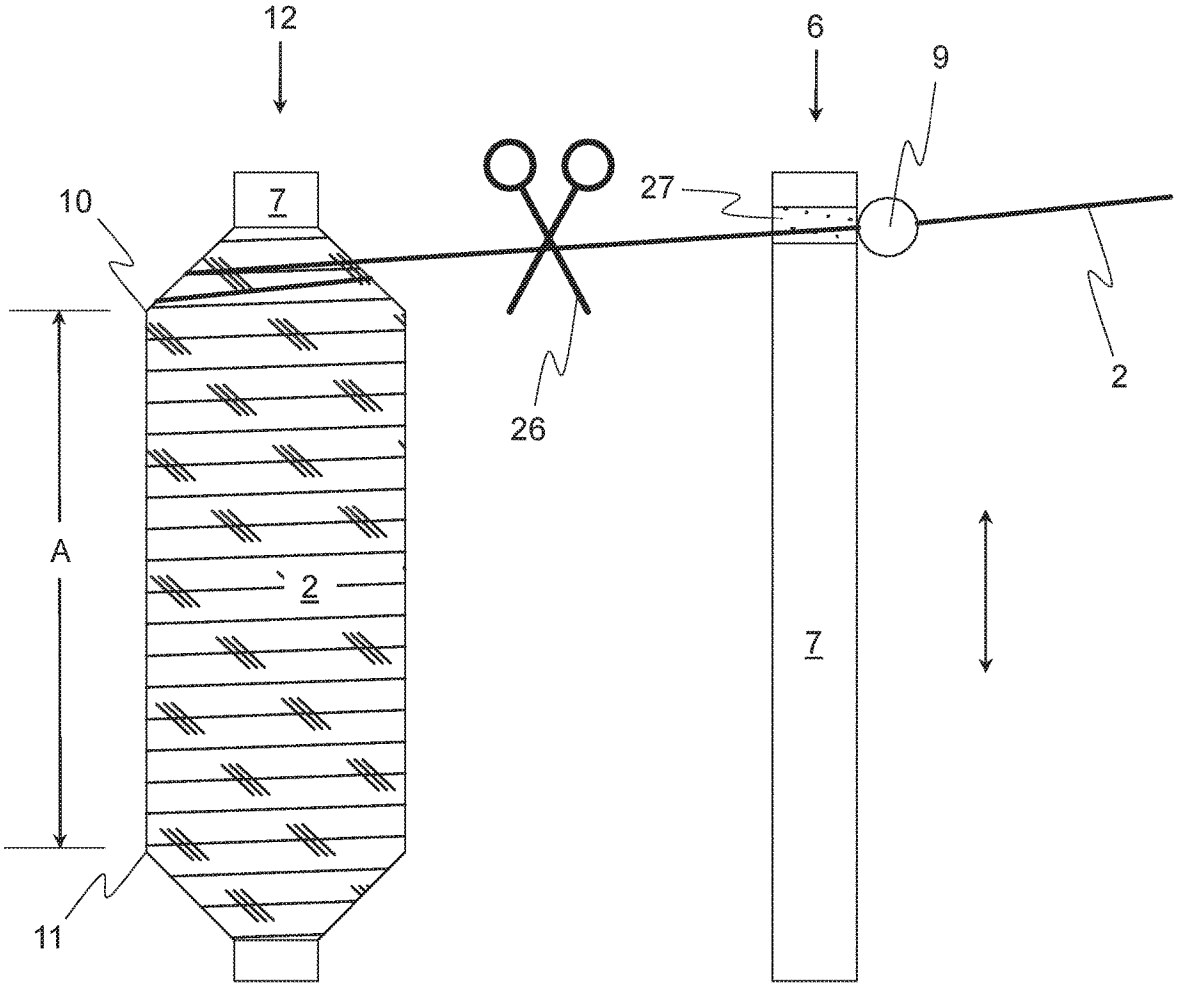
Figure 10:
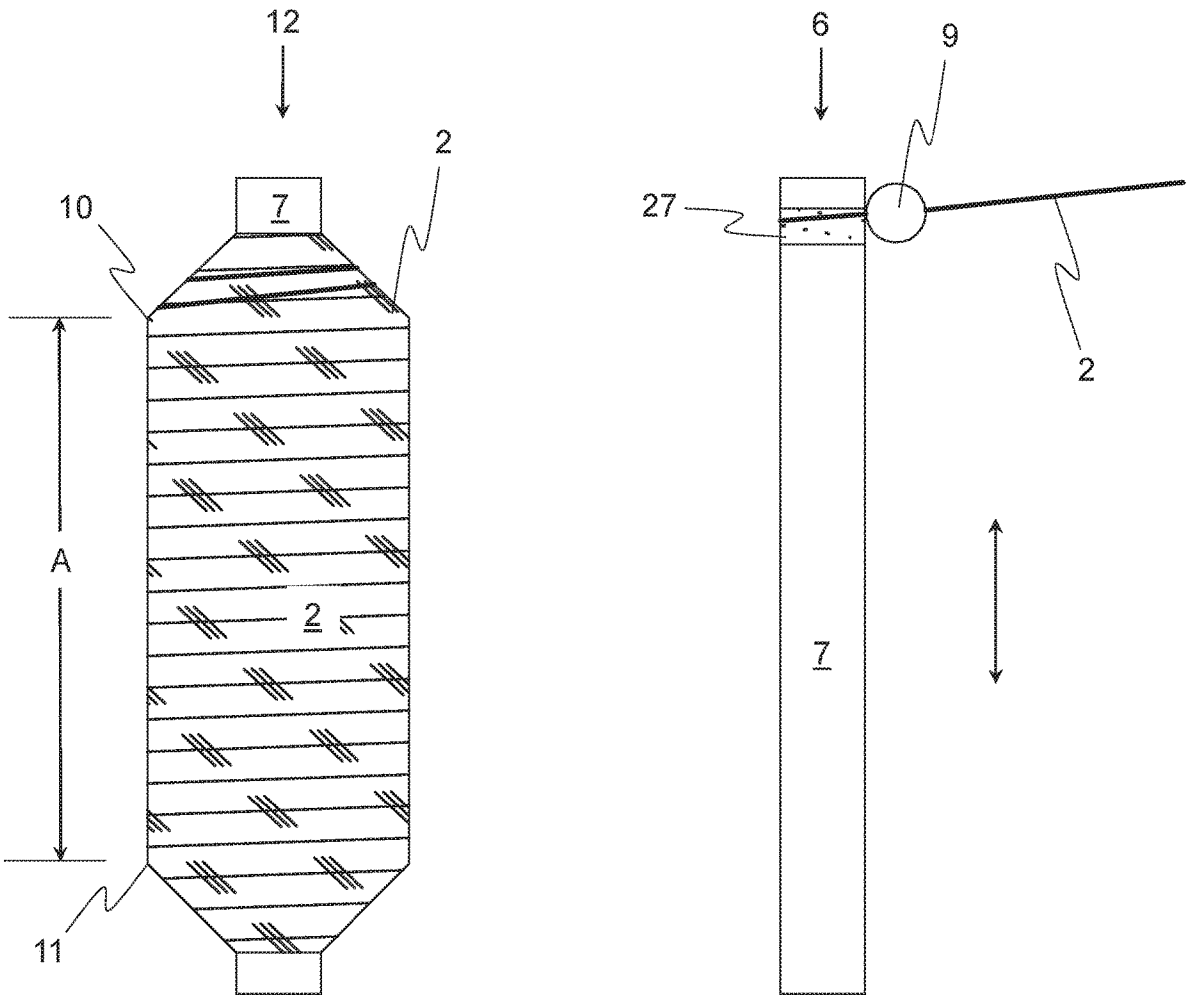

In the stage shown in FIG. 9, the roving 2 is finally cut between the wound and the empty tube 7, preferably by means of the aforementioned cutting element 26 (shown only schematically by a pair of scissors). The end of the roving 2 located on the wound tube 7 is finally wound onto the wound tube 7, while the end of the roving 2 in contact with the empty tube 7, which end is formed after the cutting process, is wound onto the tube 7 that is empty at the start of the change process (see FIG. 10).

In the last step, the wound tube 7 can then be removed from the winding device 5 and replaced by an empty tube 7. The winding device 5 is then ready for a new tube change, which is performed as soon as the tube 7 located in the region of the winding position 6 has reached the required bobbin size.

Figure 11:
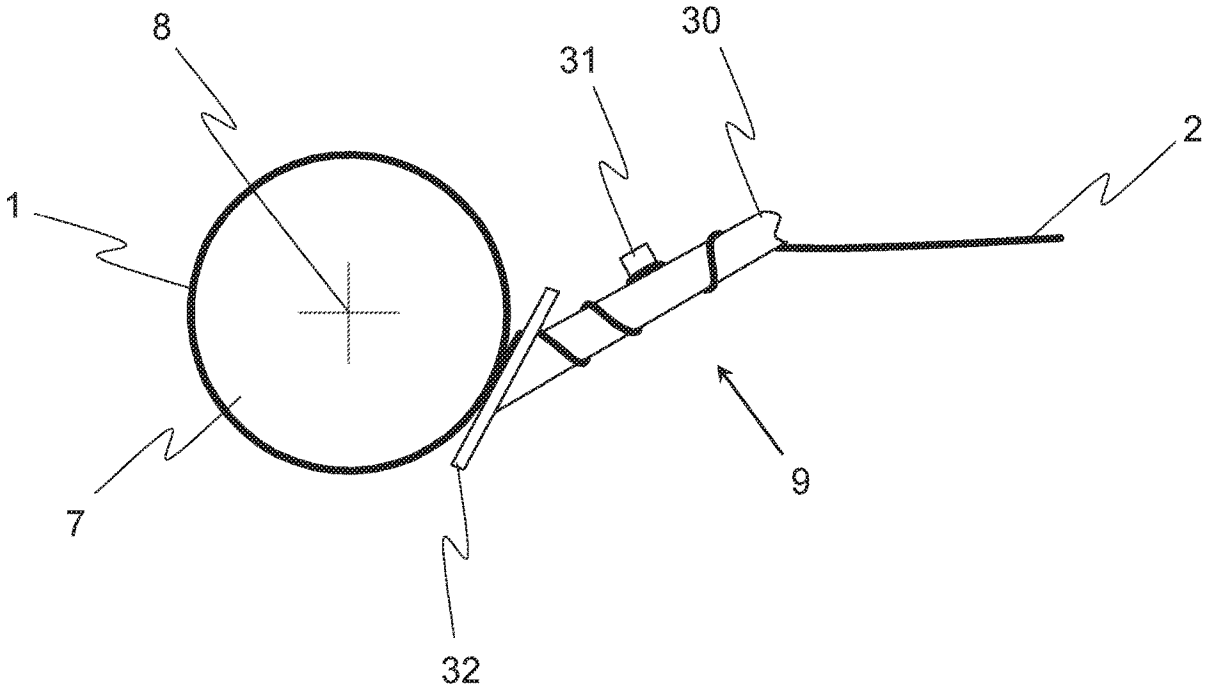
FIG. 11 shows part of one possible embodiment of a traversing element.

Finally, FIG. 11 shows part of one possible embodiment of the traversing element 9 in the form of a pressing finger already mentioned in the above description (FIG. 11 shows a plan view). The traversing element 9 comprises in principle a preferably rod-shaped wrapping section 30, around which the roving 2 is wrapped multiple times during the process of winding onto the tube 7 (the wrapping may be produced for example by rotating the wrapping section 30 about its longitudinal axis and/or by rotating a gripper 31 about said axis). The traversing element 9 further comprises a guide surface 32 for the roving 2, which guide surface during the winding process is pressed by means of a drive (not shown) against the tube 7 or the outermost position of the roving 2 wound onto the latter. As a result, a tension is introduced into the roving 2 as a result of the wrapping and the associated friction between the wrapping section 30 and the roving 2, which tension permits a tight winding of said roving onto the tube 7. A tearing of the roving 2 is prevented here by the fact that the guide surface 32 bears against the tube 7 or the outermost position of the roving 2 wound onto the latter (for further details in this regard, reference is made to the above description).

The present invention is not limited to the exemplary embodiments that have been shown and described. Modifications within the scope of the claims are also possible, as is any combination of the described features, even if they are shown and described in different parts of the description or the claims or in different exemplary embodiments.

LIST OF REFERENCE SIGNS

1 air-jet spinning machine
2 roving
3 air spinning nozzle
4 fiber bundle
5 winding device
6 winding position
7 tube
8 rotation axle
9 traversing element
10 first turning point of the traversing element
11 second turning point of the traversing element
12 tube removal position
13 drive of the tube change device
14 tube holder
15 tube change device
16 drafting system
17 drafting system roller
18 draw-off unit
19 draw-off roller
20 suction opening
21 traversing unit
22 controller
23 suction nozzle
24 suction unit
25 pivot axle of the suction nozzle
26 cutting element
27 adhesive strip
28 tube drive
29 belt
30 wrapping section
31 gripper
32 guide surface
A spacing between the turning points of the traversing element
T transport direction

The invention claimed is:

1. A method for operating a textile machine to produce roving, the method comprising:

continuously producing a roving during roving production having a protective twist from a fiber bundle fed to a consolidating means;

winding the produced roving with a winding device onto a tube arranged at a winding position;

after the tube has been fully or partially wound with the roving, initiating a tube change;

during the tube change, removing the wound tube from the winding position and moving an empty tube into the winding position;

winding the roving produced by the consolidating means onto the wound tube during the tube change at least until the roving comes into contact with the empty tube and is wound onto the empty tube, wherein the tube change from the wound tube to the empty tube is done without interruption of the continuous production of the roving by the consolidating means; and during the tube change, winding the roving onto the wound tube in a region that lies outside a region last wound prior to the tube change.

2. The method according to claim 1, wherein the consolidating means is an air spinning nozzle, the roving having the protective twist produced from the fiber bundle within the air spinning nozzle by a swirled air flow.

3. The method according to claim 1, wherein a roving delivery speed of the consolidating means during the tube change differs by at most 30% from the roving delivery speed of the consolidating means before or after the tube change.

4. The method according to claim 1, wherein the wound tube and the empty tube rotate about a respective rotation axis during the tube change.

5. The method according to claim 1, wherein during the tube change, the roving is guided by a traversing element that moves in a back and forth path parallel to the rotation axis of the wound tube.

6. The method according to claim 5, wherein after the roving has contacted the empty tube, the roving is cut between the wound tube and the empty tube.

7. The method according to claim 5, wherein immediately before the tube change, the traversing element is moved in the back and forth path between two turning points, and during the tube change the traversing element moves in the back and forth path in a region outside of the turning points.

8. The method according to claim 7, wherein during the tube change, the roving is in contact at least temporarily with both the wound tube and with the empty tube, and the roving is cut when the traversing element is in the region outside of the turning points.

9. The method according to claim 7, wherein immediately after the tube change, the traversing element is moved in the back and forth path between two turning points having a spacing that is greater than a spacing between the two turning points immediately prior to the tube change.

10. The method according to claim 1, wherein the wound tube and the empty tube are held stationary by a tube change device prior to the tube change, and during the tube change are moved by movement of the tube change device.

11. The method according to claim 10, wherein during the tube change, the wound tube is moved from the winding position to a tube removal position and the empty tube is moved from the tube removal position to the winding position.

12. A textile machine for producing a roving, comprising:

a consolidating means for producing a roving from a fiber bundle, the roving having a protective twist;

a winding device configured to wind the produced roving onto a tube; and a controller that operates the textile machine such that the roving is produced in accordance with the method of claim 1.

13. The textile machine according to claim 12, wherein the winding device comprises at least two rotationally-driven tube holders configured with a movable tube change device, the tube holders movable between a winding position and a tube removal position by movement of the tube change device.

14. The textile machine according to claim 12, wherein the consolidating means comprises an air spinning nozzle, wherein the roving having the protective twist is produced from the fiber bundle within the air spinning nozzle by means of a swirled air flow.

* * * * *